US007078607B2

(12) United States Patent
Alferness

(10) Patent No.: US 7,078,607 B2
(45) Date of Patent: Jul. 18, 2006

(54) DYNAMICALLY CHANGING MUSIC

(75) Inventor: Anton Perry Alferness, Seattle, WA (US)

(73) Assignee: Anton Alferness, Seattle, WA (US)

( * ) Notice: Subject to any disclaimer, the term of this patent is extended or adjusted under 35 U.S.C. 154(b) by 186 days.

(21) Appl. No.: 10/435,417

(22) Filed: May 9, 2003

(65) Prior Publication Data

US 2003/0212466 A1 Nov. 13, 2003

Related U.S. Application Data

(60) Provisional application No. 60/379,212, filed on May 9, 2002, provisional application No. 60/379,047, filed on May 9, 2002.

(51) Int. Cl.
*A63H 5/00* (2006.01)
*G04B 13/00* (2006.01)

(52) U.S. Cl. ..... 84/609

(58) Field of Classification Search ..... 84/609, 84/634

See application file for complete search history.

(56) References Cited

U.S. PATENT DOCUMENTS 5,693,902 A * 12/1997 Hufford et al. ..... 84/650
5,952,598 A * 9/1999 Goede ..... 84/609
5,973,255 A * 10/1999 Tanji ..... 84/636
6,093,880 A * 7/2000 Arnalds ..... 84/464 R
6,281,420 B1 * 8/2001 Suzuki et al. ..... 84/477 R
6,281,421 B1 * 8/2001 Kawaguchi ..... 84/603
6,433,266 B1 * 8/2002 Fay et al. ..... 84/609
6,683,241 B1 * 1/2004 Wieder ..... 84/609
2001/0039872 A1 * 11/2001 Cliff ..... 84/609
2003/0159566 A1 * 8/2003 Sater et al. ..... 84/615
2004/0112202 A1 * 6/2004 Smith et al. ..... 84/609

OTHER PUBLICATIONS

Acid User Manual, 1999, Sonic Foundry.*
Amazon.Com, Acid Music 3.0, Aug. 8, 2001, user reviews.*
Versiontracker.Com, Acid Pro version 4.0, May 10, 2002.*

* cited by examiner

*Primary Examiner*—Jeffrey W Donels
(74) *Attorney, Agent, or Firm*—Timothy Sullivan; Merchant & Gould

(57) ABSTRACT

The present invention provides dynamically changing musical compositions and sound compositions. Provided is a dynamic music sound file format, as well as an illustrative operating environment in which the invention may be practiced. The sound file includes many different characteristics relating to the components that are easily accessible. Each time the user listens to a song or sound composition, it may change. For example, the user may listen to a song and then play the same song again and hear a different version of the song. A script tool is used to create scripts that are used to play back a song. The scripts are user definable and may, for example, define a specific order to play the components, define the components that may be played next to each other during the playback. The possibilities for new music experience are expanded, adding tremendous value for the listener and tremendous creative opportunities for the artists.

13 Claims, 7 Drawing Sheets

| | |
|---|---|
| Type | Type |
| Date Created/Modified | Date Created/Modified |
| Size | Size |
| Tempo/Time/Play Length | Tempo/Time/Play Length |
| Pitch/Frequency/Key | Pitch/Frequency/Key |
| Volume | Volume 2 |
| Stereo/Mono | Stereo/Mono |
| Class | Class |
| FX | FX |
| User Defined | User Defined |
| | Sound File |

Markers

*FIG. 5*

DYNAMICALLY CHANGING MUSIC

CROSS REFERENCE TO RELATED APPLICATIONS

This application claims the benefit of U.S. Provisional Application Serial Nos. 60/379,212, and 60/379,047 filed May 9, 2002, the benefit of the earlier filing date of which is hereby claimed under 35 U.S.C. §119 (e).

FIELD OF THE INVENTION

This application relates generally to music playback software, and, more specifically, to dynamically changing music and sound compositions.

BACKGROUND

Recorded music is a dynamic art form, frozen in a static format. Unlike static art forms like painting or sculpture, the experience of listening to live music is dynamic.

If you were to follow an artist on tour, you would hear the same songs each night, arranged and performed with important, vital differences. You might also hear different solos, different vocal stylings, perhaps different guest musicians, as well as different energy every night.

The live music experience is only approximated in the static formats of vinyl or CD or MP3. Current technology on the consumer end does not allow variation, while nearly every other form of media has become interactive, involving the audience to participate and customize their own experience. VHS has become DVD. Phones have become PDAs. TV has become digital content on demand. But what's become of music? Only better ways to compress data.

Recorded music does not capture the dynamic spirit of the music. What is needed is a way to capture this dynamic spirit on recorded media, so that each experience of listening to a recorded piece of music can offer something new.

SUMMARY

The present invention is directed at enabling dynamically changing music compositions or dynamically changing sound compositions.

According to one aspect of the invention, a dynamic music sound file format is presented. The sound file includes many different characteristics relating to the components that are easily accessible.

According to another aspect, each time the user listens to a song it may change. For example, the user may listen to a song and then play the same song again and hear a different version of the song. There may be a whole new verse they've never heard before. Or there's a piano solo where there was a guitar previously. Or there's a twelve-piece string ensemble and no rhythm track. Or the chorus is suddenly a capela. Many of the differences between versions may in fact be subtle. For example, slight timing changes or variations on the drums. Or there is a subtle melody variation in the main vocals.

According to yet another aspect of the invention, a script tool is used to create scripts that are used to play back a song. The scripts are user definable and may, for example, define a specific order to play the components, define the components that may be played next to each other during the playback. The possibilities for new music experience are expanded, adding tremendous value for the listener and tremendous creative opportunities for the artists.

BRIEF DESCRIPTION OF THE DRAWINGS

FIG. 5 illustrates an exemplary sound file format;

DETAILED DESCRIPTION

In the following detailed description of exemplary embodiments of the invention, reference is made to the accompanied drawings, which form a part hereof, and which are shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense.

The present invention is directed at providing dynamically changing music. A dynamic music sound file format is presented, as well as an illustrative operating environment in which the invention may be practiced. The scope of the invention also includes sound as defined by anything audible, including narrative works, musical compositions that include sound or sound elements, or sound accompaniment in the context of a visual body of work such as film or video.

Figure 4:
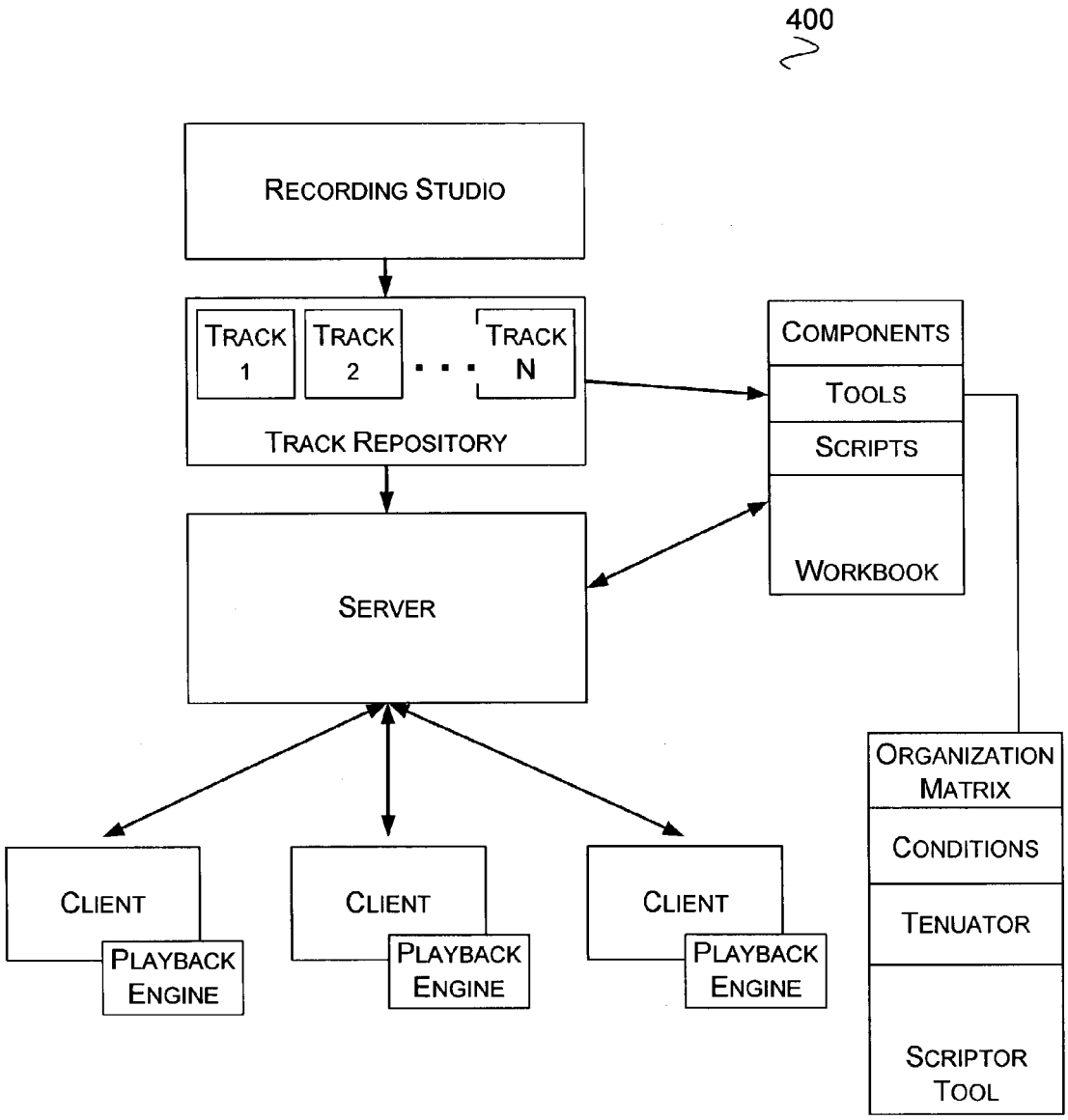
FIG. 4 illustrates a block diagram of a dynamically changing music system.

FIG. 4 illustrates a block diagram of a dynamically changing music system M3 or Multi-Mix Matrix, in accordance with aspects of the invention. As illustrated in the figure, dynamically changing music system 400 includes a recording studio, tracks, a workbook, a server, clients, and playback engine. Not all the components may be required to practice the invention, and variations in the arrangement and type of the components may be made without departing from the spirit or scope of the invention.

M3 is the new dimension of music technology by which an artist can create dynamic bodies of work that expand instead of remaining frozen in a singular representation. Multi-Mix Matrix 400 is a new mode of recording and playing back music information in a way that allows variability in an art form (the art form of recorded music) that has always been static. M3 is music that can constantly evolve. M3 enables music to be separated into its core components, coded, and built into a matrix that allows variability and interoperability among those components.

Sound elements of each song may be isolated such as vocals, guitar, bass, drums, keyboards, etc. or composites of parts such as drums and bass, based on song structure and intent of the artist or sound engineer. Characteristics of these component parts will be programmed into the file structure—pitch, tempo, chord structure, and so on—so that the playback engine can be programmed to make intelligent choices based on music theory. These sound elements are stored within a sound file that may be accessed and manipulated (See FIG. 5 and related discussion). Variability is built into the music architecture, allowing endless possibilities for creativity, originality, and innovation, as well as responsive new experiences for the listener.

M3 may provide many advantages to the recording industry, including combating piracy; preserving capital; creating new revenue streams; and evolving the recorded music art form;

Multi-Mix Matrix is a bridge between the two industries: Music and Software. By building the music into software architecture, many software protection schemes against piracy may be used to protect the music from piracy. According to one embodiment of the invention, the server may maintain control over the music never allowing the client to fully download all the data to play a song, but rather combine all the data from two locations at the point of playback. Additionally, the playback engine may be designed to include copy protection against unauthorized playback.

The potential for new revenue streams for old music content is enabled. Imagine if you could by an M3 version of you favorite album from 20 years ago, remixed with added material. Using M3 a user of the M3 system could take the studio outtakes from a Miles Davis session and remix them enabling those tracks to become interoperable, so that every time you played your M3 Miles release, you heard a different solo on My Funny Valentine.

There is a massive archive of material that is coveted by music lovers that can be rejuvenated using Multi-Mix Matrix and released again to the amazement and joy of fans everywhere.

M3 is a paradigm shift. Artists are able to create works that change according to preset variables, or respond to the listener's taste, or even correspond to the time of day. Any number of factors determining when and how to change the content of the music within the context of the artist's controlled allowances, would become possible.

According to one embodiment, the sound elements are stored in the scripts section of the workbook. The workbook is the software platform used to build, control, and playback a song or a musical or sonic body of work. The scripts section allows different modes of music to become interchangeable. Now, instead of a user being able to store 1,000 songs on their hard drive, they may have 100,000 interoperable units of sound. Being able to combine sound tracks in many different ways allows the number of variations of songs to increase. For example, the same guitar riff may be able to be included in many different songs. Additionally, one song may have 20 different guitar solos.

M3 allows prolific artists to release new versions of songs, much like companies release new versions of software. Consumers may buy upgrades of their favorite musical releases. The artist and record label will profit from additional sales to the same people who bought the original release, and fans would get to experience that artist in a whole new way.

The workbook is used by users, such as sound engineers, producers, and artists as the interface to create scripts that direct a playback engine that executes the dynamic music or sound compositions. The workbook encompasses a unit of music, for example a song, but may contain multiple pages. Each so-called page represents and controls a version of the song or the composition embodied in the workbook. The scriptor tool allows the selection of which sound files to use, when to play them, how to play them; essentially to generate rules regarding who, what, when and where. The playback engine is able to recognize sound files that are compatible with each other based on the information programmed into each of the sound files, regarding the nature of the content of the sound files.

The scriptor may receive sound tracks from many different locations. The sound tracks may come from a sound track repository, directly from the recording studio, or some other source. The scriptor controls the playback engine's use of sound files (components) and controls use of modification/attenuation tools controlled by playback engine.

For example, the user may create scripts that determine the dynamic version of a song or sound composition. The user may set up a script that places a guitar solo within a song based on marker positions set within the song. The guitar solos may be chosen based on a wide variety of characteristics. For example, the solo may be selected based on the class of the solo (example: Jazz solo).

Attenuation tools may be used to modify an entire sound file or a portion of a sound file when identified for a use in a composition and further identified as having need of modification. Reasons for modification could include timing or tempo errors, frequency or key variance, and arrangement or continuity alignment. These attenuation tools may attenuate a given sound file or multiple sound files at the point of playback or prior to playback.

The playback engine makes an analysis of the sound files in context of a song construct, and further analysis of any additional or variable sound files that could be additionally built into another mix version of that song. This analysis is based on musical and organizational characteristics of the sound files within the context of a song construct for the purposes of multiple mix outcomes.

Existing multi-track environments or portions of existing environments may be imported into or connected to the scriptor and playback engine. Some of the multi-track environments the scriptor is directed at importing or connecting to include ProTools, Sonic Foundry, Cubase, and the like.

The scriptor tool allows the user to configure the compositions that may be played in the playback engine. The user may set many attributes within a sound file to allow the playback engine to be able to play and manipulate the sound files.

The user may set what tracks or files may be used. When, and what parts of tracks may be used. For example, on a linear scale a user may set when a track may play. Volume may be adjusted. Various volumes may be used within the same track.

Whether the audio is mono/stereo may be adjusted. The position of the sound relative to some known position within the field of stereo (pan). Other parameters, such as FX parameters, dynamics, such as (EQ, Compressor, gate, and the like) may be set either through pre playback or by connecting to signal processors during the execution of playback. A configurable input parameter may also be used. A user input field may indicate the class of the sound file, or an instrument definition.

Based on the analysis of the class system, playback scheme (intent, style) and frequency analysis the appropriate parameters may be set to produce a complete song.

Volumes of the sound files react to each other and self-modify their volume levels. Frequency analysis of the tracks may be used to adjust the volume levels. Many off the shelf tools may be used to perform the frequency analysis. For example, if there are three sound files that have low frequencies, their volume adjustments are then directed by the intent of the song and one or more of the three sound files will be adjusted lower in accordance with the hierarchy of song structure or intent The volume matrix may also be used to smooth out areas of misalignment and inconsistent arrangement structure. For example, if a new guitar solo sound file which is 18 seconds in length is introduced into a song construct and that allows for a 14 second solo, volume will be attenuated either on the front end or the back end of the introduced guitar solo to fit in the structure. Another example might be to interpret a multiplicity of volume dynamics subtly on an overall set of mix options.

The music recording process (in studio) has always been based on a simple concept: isolation. Each instrument is recorded on an individual track, so that factors such as volume, tone, and effect can be adjusted without altering other musical elements. The sound engineer gets every instrument or vocal recording set just right, and then mixes all the tracks down to a stereo pair.

With M3, many old studio sessions can be remastered to allow for variation, because most master recordings are made up of isolated parts. In addition, new recording sessions can increase their scope due to the multiplicity of outcomes being enabled by the M3 platform. Artists will know they do not have to reduce their options, they will have the opportunity to explore their options.

The music architecture makes it possible to convert back catalog recordings into new releases with added value. By incorporating alternate takes and different instrumentations, record labels can re-release old favorites to an established, adoring fan base that already purchases box sets with no new content included.

Sound File

FIG. 5 illustrates an exemplary sound file format, according to one embodiment of the invention. The sound file for the dynamically changing music system includes many different fields and components. As shown in the figure, the sound file includes the type of sound file; the date created/last modified; the size; the time play length/rhythmic; the pitch/frequency/key; the volume; the stereo/mono characteristics; the class (instrument, intent) of the sound file; the markers and marker types; the FX-type-class, and a user defined field(s). The sound file format includes the parameters to combine and modify various sound components to create the dynamically changing composition. Markers may be used within the file to associate certain portions of the sound file with various parameters. For example, one component of the sound file may have one volume, while another portion of the sound file has a different volume. The markers allow the sound files to contain more than one set of parameters.

The sound files may be stored many different ways and on many different formats. The sound file parameters may be accessed in many different ways quickly and efficiently. For example, a code, such as a bar code, may store the various parameters associated with the sound file. Other identifiers may also be used, including: integers; shapes–geometry (tone) Height=frequency; colors (frequency); linear or circular/radial, and the like. All with the purpose of giving the playback engine a fast and accurate method of understanding the musical or sonic make-up of the files.

Sound files may be stored many different ways. Sound files may be encoded and compressed. For example, the sound file may be compressed at a 12 or 16 bit sample rate. The sound file is read by a playback engine that may decode the compressed sound file. For example, the sound file may be decoded to 24 bit.

According to another embodiment, the sound file may be encoded into different files. For example, the audio portion of the sound file may be the audio, where another file includes the other includes the FX type. The sound file is encoded to be modifiable, malleable, and effected by a playback engine.

Sound files may be compared to other sound files of the same type and discern integration possibilities and modification requirements based on sound file attributes. An off the shelf tool, or a custom tool, may be used for the comparison. Sound files are configured to work with multi-track volume control matrix.

Figure 6:
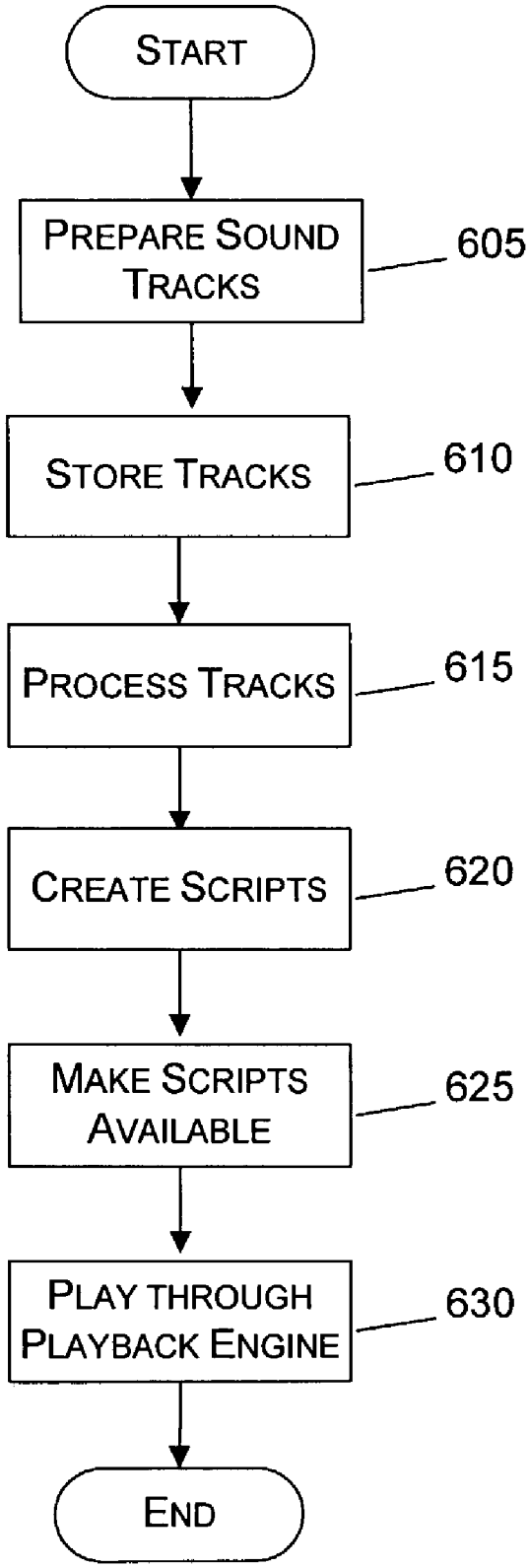
FIG. 6 illustrates a process flow for creating and playing dynamically changing music.

FIG. 6 illustrates a process flow for creating and playing dynamically changing music, in accordance with aspects of the invention.

After a start block, the process flows to block 605, where the sound tracks are prepared. The sound tracks may be prepared in a recording studio and processed using many of the available music programs, including, but not limited too: ProTools, Sonic Foundry, and Cubase. Moving to block 610, the tracks are stored in a repository. According to one embodiment of the invention, the tracks are stored on a server that is coupled to the recording studio and the workbook environment. Transitioning to block 615, the tracks are processed. Processing tracks may be performed manually or automatically. A user may manually modify a track so that it has the sound they are looking for. For example, the user may process the track so that it will play in a particular style of music, such as Jazz, or Rock. A program may automatically select tracks for a script based on characteristics of the track. For example, the program may look for certain tempos, frequencies, and the like, and select and process the tracks based on the selected characteristics. Flowing to block 620, the scripts are created. The scripts define how the sound tracks are organized and played together. The process then transitions to block 625, where the scripts are made available to the playback device. The scripts may be stored on a server accessible by the device or they may be delivered to the user of the device through another medium, such as by a CD, DVD, and the like. Once the user has the scripts and access to the associated sound files, the user may play the music through the playback engine on the device. Each time the user plays the same music title, they may hear a different version of the tune. According to one embodiment of the invention, the number of different versions may be limited from the entire set of versions available, thereby creating an additional revenue source should the user desire to purchase the new content. The process then moves to an end block and returns to processing other actions.

Figure 7:
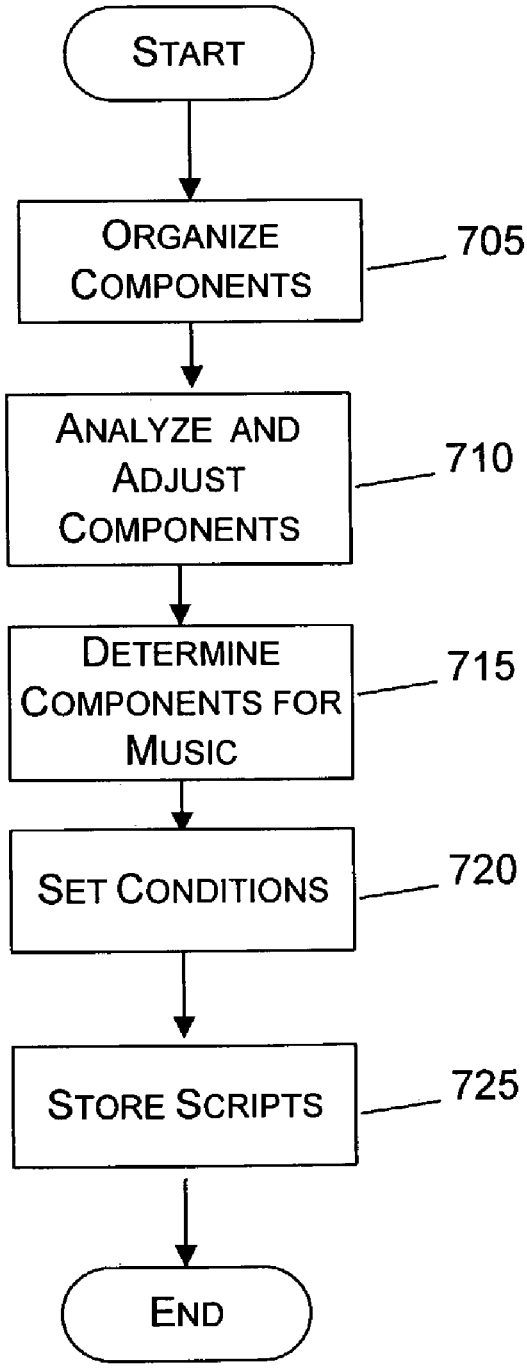
FIG. 7 shows a process for creating scripts, in accordance with aspects of the invention.

FIG. 7 shows a process for creating scripts, in accordance with aspects of the invention. After a start block, the process flows to block 705, where the components are organized. According to one embodiment of the invention, the components are organized based on the characteristics of the component. For example, all guitar tracks for a particular song may be organized together. The process then moves to block 710 where the components are analyzed and adjusted. The components may be analyzed to determine if the components will sound correct when played one after another. For example, the frequencies, volumes, tempo, and the like may be analyzed. Transitioning to block 715, the components that form the dynamically changing music will be selected. A user creating the script may determine that they want to include three different drum tracks, five different bass tracks, two different solos, and the like, that may be played in different versions of the song. Once the components have been determined, the user may set the conditions determining when the components should play together. The conditions may specify that the components are selected randomly, or according to a preset routine. Once the scripts are created, the scripts are stored for later use by the playback engine. According to one embodiment of the invention, the scripts are stored in a workbook containing all of the sound components used in the creation of the dynamically changing song. The process then moves to an end block and returns to processing other actions.

Illustrative Operating Environment

Figure 1:
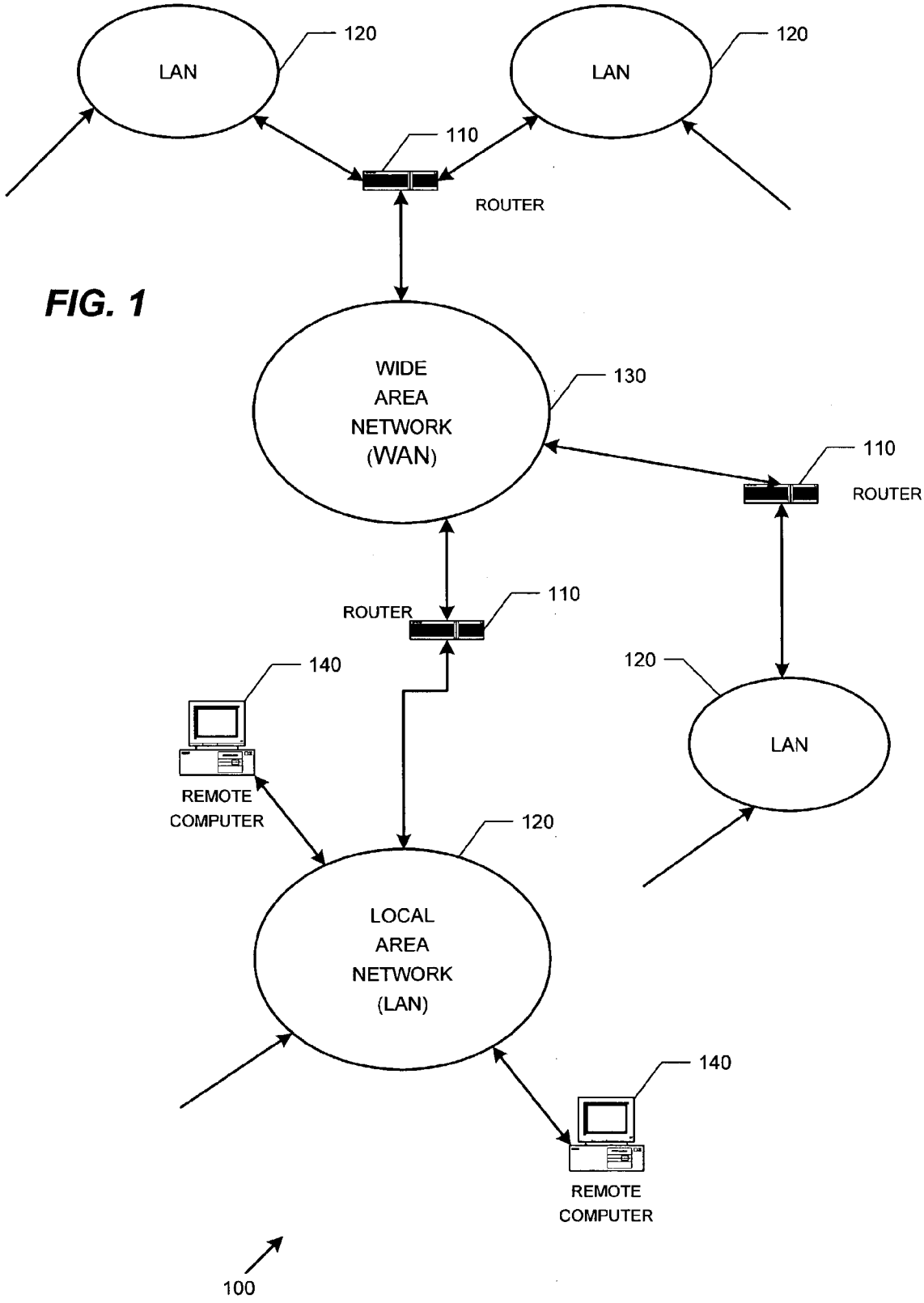
FIGS. 1–3 show components of an exemplary environment in which the invention may be practiced.
Figure 2:
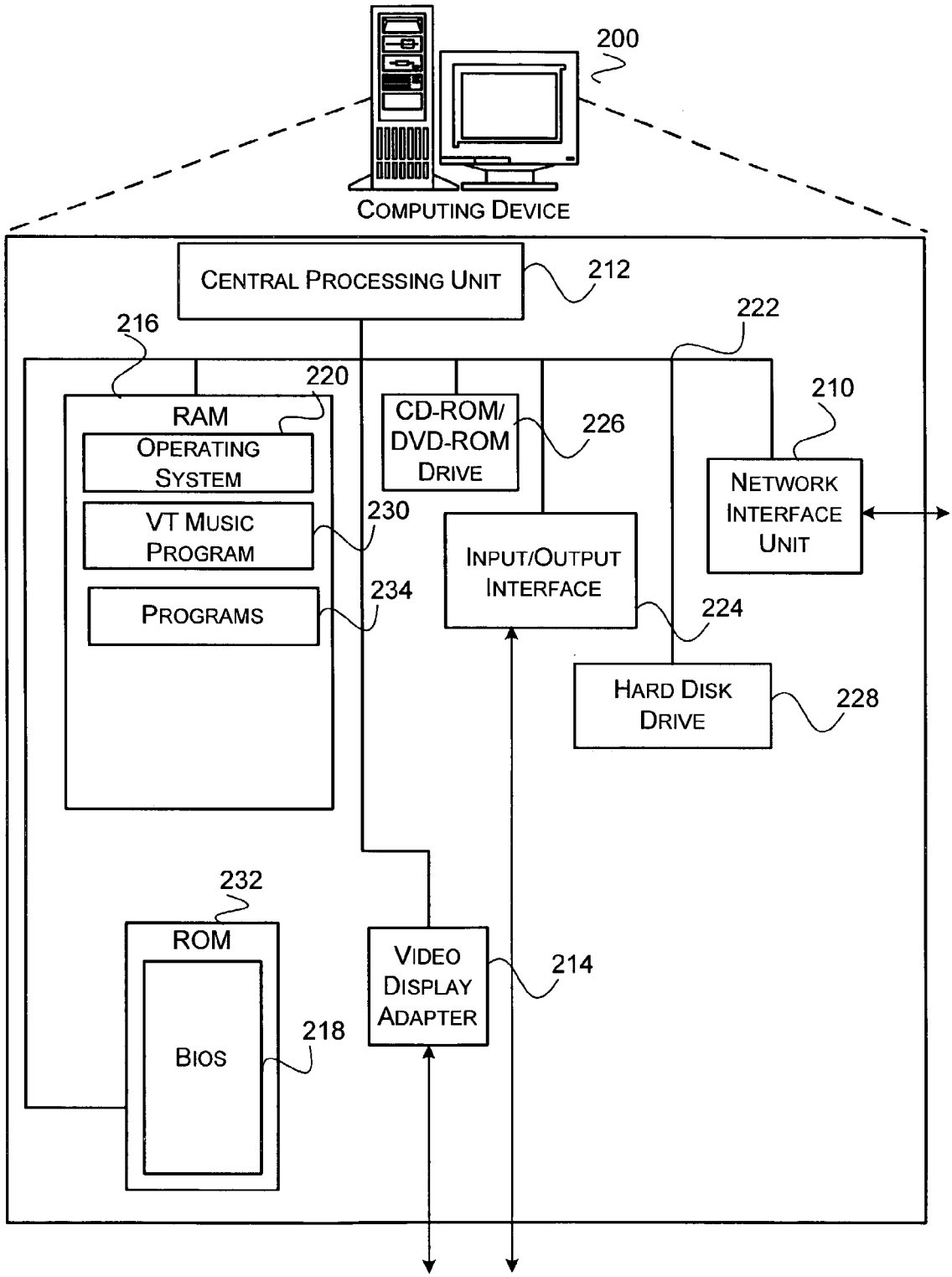
Figure 3:
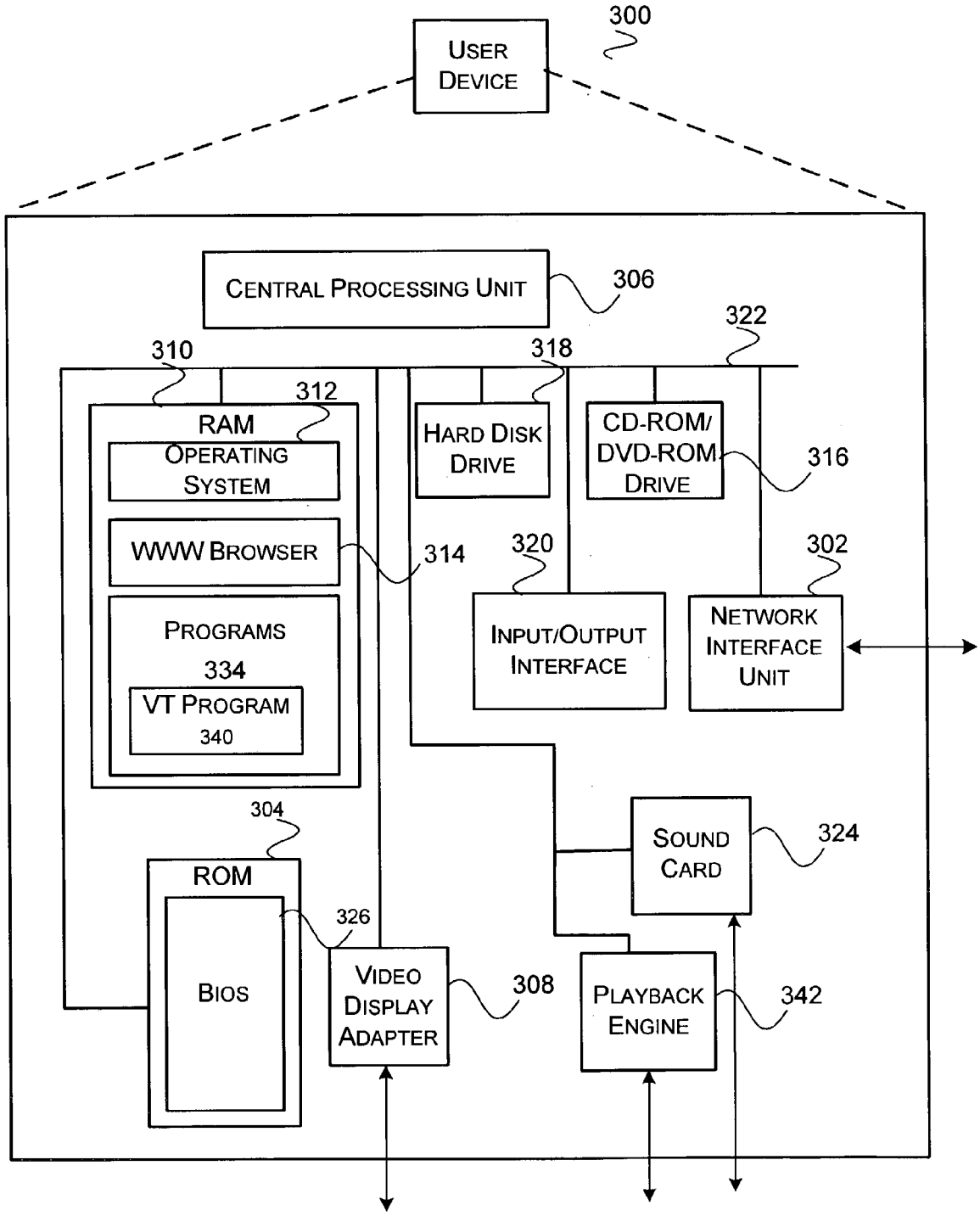

FIGS. 1–3 show components of an exemplary environment in which the invention may be practiced. Not all the components may be required to practice the invention, and variations in the arrangement and type of the components may be made without departing from the spirit or scope of the invention.

FIG. 1 shows a plurality of local area networks ("LANs") 120 and wide area network ("WAN") 130 interconnected by routers 110. Routers 110 are intermediary devices on a communications network that expedite message delivery. On a single network linking many computers through a mesh of possible connections, a router receives transmitted messages and forwards them to their correct destinations over available routes. On an interconnected set of LANs—including those based on differing architectures and protocols—, a router acts as a link between LANs, enabling messages to be sent from one to another. Communication links within LANs typically include twisted pair, fiber optics, or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links, or other communications links known to those skilled in the art. Furthermore, computers, such as remote computer 140, and other related electronic devices can be remotely connected to either LANs 120 or WAN 130 via a modem and temporary telephone link. The number of WANs, LANs, and routers in FIG. 1 may be increased or decreased arbitrarily without departing from the spirit or scope of this invention.

As such, it will be appreciated that the Internet itself may be formed from a vast number of such interconnected networks, computers, and routers. Generally, the term "Internet" refers to the worldwide collection of networks, gateways, routers, and computers that use the Transmission Control Protocol/Internet Protocol ("TCP/IP") suite of protocols to communicate with one another. At the heart of the Internet is a backbone of high-speed data communication lines between major nodes or host computers, including thousands of commercial, government, educational and other computer systems, that route data and messages. An embodiment of the invention may be practiced over the Internet without departing from the spirit or scope of the invention.

The media used to transmit information in communication links as described above illustrates one type of computer-readable media, namely communication media. Generally, computer-readable media includes any media that can be accessed by a computing device. Computer-readable media may include computer storage media, communication media, or any combination thereof.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, communication media includes wired media such as twisted pair, coaxial cable, fiber optics, wave guides, and other wired media and wireless media such as acoustic, RF, infrared, and other wireless media.

The Internet has recently seen explosive growth by virtue of its ability to link computers located throughout the world. As the Internet has grown, so has the WWW. Generally, the WWW is the total set of interlinked hypertext documents residing on HTTP (hypertext transport protocol) servers around the world. Documents on the WWW, called pages or Web pages, are typically written in HTML (Hypertext Markup Language) or some other markup language, identified by URLs (Uniform Resource Locators) that specify the particular machine and pathname by which a file can be accessed, and transmitted from server to end user using HTTP. Codes, called tags, embedded in an HTML document associate particular words and images in the document with URLs so that a user can access another file, which may literally be halfway around the world, at the press of a key or the click of a mouse. These files may contain text (in a variety of fonts and styles), graphics images, movie files, media clips, and sounds as well as Java applets, ActiveX controls, or other embedded software programs that execute when the user activates them. A user visiting a Web page also may be able to download files from an FTP site and send messages to other users via email by using links on the Web page.

A server may provide a WWW site. A server is a computing device connected to the Internet having storage facilities for storing hypertext documents for a WWW site and running administrative software for handling requests for the stored hypertext documents. A hypertext document normally includes a number of hyperlinks, i.e., highlighted portions of text which link the document to another hypertext document possibly stored at a WWW site elsewhere on the Internet. Each hyperlink is associated with a URL that provides the location of the linked document on a server connected to the Internet and describes the document. Thus, whenever a hypertext document is retrieved from any WWW server, the document is considered to be retrieved from the WWW. As is known to those skilled in the art, a WWW server may also include facilities for storing and transmitting application programs, such as application programs written in the JAVA programming language from Sun Microsystems, for execution on a remote computer. Likewise, a WWW server may also include facilities for executing scripts and other application programs on the WWW server itself.

A user may retrieve hypertext documents from the WWW via a WWW browser application program located on a wired or wireless device. A WWW browser, such as Netscape's NAVIGATOR® or Microsoft's INTERNET EXPLORER®, is a software application program for providing a graphical user interface to the WWW. Upon request from the user via the WWW browser, the WWW browser accesses and retrieves the desired hypertext document from the appropriate WWW server using the URL for the document and HTTP. HTTP is a higher-level protocol than TCP/IP and is designed specifically for the requirements of the WWW. HTTP is used to carry requests from a browser to a Web server and to transport pages from Web servers back to the requesting browser or client. The WWW browser may also retrieve application programs from the WWW server, such as JAVA applets, for execution on a client computer.

FIG. 2 shows an exemplary computing device that may operate to perform aspects of the invention.

Computing device 200 may include many more components than those shown in FIG. 2. However, the components shown are sufficient to disclose an illustrative environment for practicing the present invention. As shown in FIG. 2, computing device 200 is connected to WAN/LAN 100, or other communications network, via network interface unit 210. The network interface unit 210 includes the necessary circuitry for connecting computing device 200 to WAN/LAN 100, and is constructed for use with various communication protocols including the TCP/IP protocol. Typically, network interface unit 210 is a card contained within computing device 200.

Computing device 200 also includes processing unit 212, video display adapter 214, and a mass memory, all connected via bus 222. The mass memory generally includes random access memory ("RAM") 216, read-only memory ("ROM") 232, and one or more permanent mass storage devices, such as hard disk drive 228, a tape drive (not shown), optical drive 226, such as a CD-ROM/DVD-ROM drive, and/or a floppy disk drive (not shown). The mass memory stores operating system 220 for controlling the operation of computing device 200. This component may comprise a general purpose server operating system, such as UNIX, LINUX™, Microsoft WINDOWS NT®, and the like. Basic input/output system ("BIOS") 218 is also provided for controlling the low-level operation of server 200.

The mass memory as described above illustrates another type of computer-readable media, namely computer storage media. Computer storage media may include volatile and nonvolatile, removable and non-removable media implemented in any method or technology for storage of information, such as computer readable instructions, data structures, program modules or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computing device.

The mass memory may also store program code and data for providing tools relating to playing and creating dynamically changing music. More specifically, the mass memory may store applications including music program 230, and programs 234. VT music program 230 includes computer executable instructions which, when executed by computing device 200, import and generate dynamically changing music. Computing device 200 may include a JAVA virtual machine, an SMTP handler application for transmitting and receiving email, an HTTP handler application for receiving and handing HTTP requests, JAVA applets for transmission to a WWW browser executing on a client computer, and an HTTPS handler application for handling secure connections. The HTTPS handler application may be used for communication with an external security application to send and receive sensitive information, such as credit card information, in a secure fashion.

Computing device 200 also comprises input/output interface 224 for communicating with external devices, such as a mouse, keyboard, scanner, or other input devices not shown in FIG. 2. Likewise, computing device 200 may further comprise additional mass storage facilities such as optical drive 226 and hard disk drive 228. Hard disk drive 228 is utilized by computing device 200 to store, among other things, application programs, databases, and program data used by music program 230. For example, sound files, and databases may be stored.

FIG. 3 depicts several components of an exemplary user device 300. User device 300 may include many more components than those shown in FIG. 3. According to one embodiment of the invention, user device 300 is a mobile device that may or may not be coupled to a network. However, it is not necessary that those generally-conventional components be shown in order to disclose an illustrative embodiment for practicing the present invention. As shown in FIG. 3, user device 300 includes network interface unit 302 for connecting to a LAN or WAN, or for connecting remotely to a LAN or WAN. Network interface unit 302 includes the necessary circuitry for such a connection, and is also constructed for use with various communication protocols including the TCP/IP protocol, the particular network configuration of the LAN or WAN it is connecting to, and a particular type of coupling medium. Network interface unit 302 may also be capable of connecting to the Internet through a point-to-point protocol ("PPP") connection or a serial line Internet protocol ("SLIP") connection as known to those skilled in the art.

User device 300 also includes BIOS 326, processing unit 306, video display adapter 308, memory, and playback engine 342. The memory generally includes RAM 310, ROM 304, and a permanent mass storage device, such as a disk drive. The memory stores operating system 312 and programs 334 for controlling the operation of user device 300. The memory may also include a WWW browser 314, such as Netscape's NAVIGATOR® or Microsoft's INTERNET EXPLORER® browsers, for accessing the WWW. It will be appreciated that these components may be stored on a computer-readable medium and loaded into memory of user device 300 using a drive mechanism associated with the computer-readable medium, such as a floppy disk drive (not shown), optical drive 316, such as a CD-ROM/DVD-ROM drive, and/or hard disk drive 318. Input/output interface 320 may also be provided for receiving input from a mouse, keyboard, or other input device. The memory, network interface unit 302, video display adapter 308, and input/output interface 320 are all connected to processing unit 306 via bus 322. Other peripherals may also be connected to processing unit 306 in a similar manner.

Playback engine 342 is configured to play the music components in response to scripts associated with the music. Playback may be programmed in software or programmed in hardware. The script may instruct the playback engine to play a series of components in a variety of different ways. The playback engine may also be programmed to analyze components on its own to determine if different components within a workbook may be played together.

As will be recognized from the discussion, aspects of the invention may be embodied on computing device 200, on user device 300, or on some combination thereof. For example, programming steps may be contained in programs 334 and/or programs 234.

The various embodiments of the invention may be implemented as a sequence of computer implemented steps or program modules running on a computing system and/or as interconnected machine logic circuits or circuit modules within the computing system. The implementation is a matter of choice dependent on the performance requirements of the computing system implementing the invention. In light of this disclosure, it will be recognized by one skilled in the art that the functions and operation of the various embodiments disclosed may be implemented in software, in firmware, in special purpose digital logic, or any combination thereof without deviating from the spirit or scope of the present invention.

The above specification, examples and data provide a complete description of the manufacture and use of the composition of the invention. Many embodiments of the invention can be made without departing from the spirit or scope of the invention.

What is claimed is:

1. A method for dynamically changing musical compositions and sound compositions, comprising:

generating components from tracks that have been recorded;

storing the components for a sound composition; wherein a subset of the components for the sound composition are used for any particular version of the sound composition;

using a script to define, control, modify and play a version of a sound composition; wherein the script details the interaction of the components used within the many versions of the sound composition; and generating a workbook that contains the script and the components used within a sound composition that has different versions.

2. The method of claim 1, further comprising generating the script that details the interaction of the components used within different versions of the sound composition.

3. The method of claim 2, wherein the components include at least three characteristics that are selected from a set including: a type of sound file; a date created/last modified; a size; a time play length/rhythmic; a pitch/frequency/key; a volume; a stereo/mono characteristic; a class; a marker and marker types; a FX-type-class, and a user defined field.

4. The method of claim 1, wherein storing the components for a sound composition further comprises storing the components on a server accessible by clients.

5. The method of claim 2, further comprising encrypting the components.

6. The method of claim 1, further comprising dynamically selecting a subset of the components for the sound composition without receiving interaction from a user; and playing the sound composition that was dynamically generated.

7. An apparatus for dynamically changing musical compositions and sound compositions, comprising:

a processor and a computer-readable medium;

an operating environment stored on the computer-readable medium and executing on the processor; and a playback device operating under the control of the operating environment and operative to perform actions, including:

storing components for different versions of a sound composition; wherein the components are generated from tracks that have been recorded; wherein a subset of the components for the sound composition are used for any particular version of the sound composition;

using a script to play a version of the sound composition; wherein the script details the interaction of the components used within the version of the sound composition; and wherein each time the script is used to play the sound composition a different version of the sound composition may be played by the playback engine without receiving interaction from a user; and generating a workbook that contains the script and the components used within a sound composition that has different versions.

8. The apparatus of claim 7, further comprising using a network interface layer to access the components for the different versions of the sound composition.

9. The apparatus of claim 8, further comprising analyzing the components to determine how to play the components for the version of the sound composition.

10. A system for dynamically changing music and sound compositions, comprising:

a server, including:

a processor and a computer-readable medium;

an operating environment stored on the computer-readable medium and executing on the processor;

a network interface layer operating under the control of the operating environment and configured to connect with another device; and a memory configured to store components associated with dynamic music; wherein the components are generated from tracks that have been recorded; and a client, including:

a processor and a computer-readable medium;

an operating environment stored on the computer-readable medium and executing on the processor;

a network interface layer operating under the control of the operating environment and configured to connect with another device; and a scripting device operating under the control of the operating environment and operative to perform actions, including:

accessing the components from the server;

organizing components;

analyzing the components;

determining the components used within different versions of a sound composition;

generating conditions indicating what components to play within the different versions of the sound composition;

storing the components for different versions of the sound composition; and generating a workbook that contains the script and the components used within a sound composition that has different versions.

11. The system of claim 10, further comprising generating the script that details the interaction of the components used within different versions of the sound composition.

12. The system of claim 11, wherein the components include at least three characteristics that are selected from a set including: a type of sound file; a date created/last modified; a size; a time play length/rhythmic; a pitch/frequency/key; a volume; a stereo/mono characteristic; a class; a marker and marker types; a FX-type-class, and a user defined field.

13. The system of claim 11, further comprising encrypting the components.

* * * * *